US010330309B2

(12) United States Patent
Morishita et al.

(10) Patent No.: US 10,330,309 B2
(45) Date of Patent: Jun. 25, 2019

(54) BOILER

(71) Applicant: MITSUBISHI HITACHI POWER SYSTEMS, LTD., Kanagawa (JP)

(72) Inventors: Kunihiro Morishita, Tokyo (JP); Masaki Shimono, Tokyo (JP); Motoki Kato, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 0 days.

(21) Appl. No.: 15/556,127

(22) PCT Filed: Feb. 17, 2016

(86) PCT No.: PCT/JP2016/000835
§ 371 (c)(1),
(2) Date: Sep. 6, 2017

(87) PCT Pub. No.: WO2016/152009
PCT Pub. Date: Sep. 29, 2016

(65) Prior Publication Data

US 2018/0045402 A1 Feb. 15, 2018

(30) Foreign Application Priority Data

Mar. 24, 2015 (JP) ..... 2015-060264

(51) Int. Cl.
*F22B 37/10* (2006.01)
*F22B 21/34* (2006.01)

(52) U.S. Cl.
CPC ..... *F22B 37/107* (2013.01); *F22B 21/341* (2013.01); *F22B 37/10* (2013.01); *F22B 37/102* (2013.01)

(58) Field of Classification Search
CPC ..... F22B 37/107; F22B 37/102; F22B 21/341
See application file for complete search history.

(56) References Cited

U.S. PATENT DOCUMENTS 3,448,726 A * 6/1969 Litwinoff ..... F22B 35/001 122/235.11
3,675,628 A * 7/1972 Seibold ..... F22B 37/24 122/510

(Continued)

FOREIGN PATENT DOCUMENTS

JP 60-86703 6/1985
JP 2-14507 1/1990

(Continued)

OTHER PUBLICATIONS

International Search Report dated May 24, 2016 in International (PCT) Application No. PCT/JP2016/000835.

(Continued)

*Primary Examiner* — Nathaniel Herzfeld
(74) *Attorney, Agent, or Firm* — Wenderoth, Lind & Ponack, L.L.P.

(57) ABSTRACT

The boiler (1) according to an aspect of the present invention is provided with a boiler main body (3) and a steel support frame (5) that suspends and supports the boiler main body (3). The boiler main body (3) is provided with: a furnace wall (11) composed of water pipes (15) and plate-like fins (16) arranged in an alternating manner; an internal element (4) housed inside the furnace wall (11); and a buffering mechanism (20) configured to attenuate vibration energy when relative displacement, of the internal element (4) with respect to the furnace wall (11), occurs that exceeds a predetermined value. The buffering mechanism (20) is disposed between the furnace wall (11) and the internal element (4) in the main vibration direction of the internal element (4), and the load on the buffering mechanism (20) caused by interference is transmitted to the fins (16).

15 Claims, 7 Drawing Sheets

(56) References Cited

U.S. PATENT DOCUMENTS

| | | | | | |
|---|---|---|---|---|---|
| 4,286,549 | A * | 9/1981 | Eisinger | F22B 37/244 | 122/510 |
| 4,789,028 | A * | 12/1988 | Gowda | F22B 37/206 | 138/173 |
| 5,072,786 | A * | 12/1991 | Wachter | F22B 37/206 | 165/162 |
| 5,154,139 | A * | 10/1992 | Johnson | F16L 57/00 | 122/235.12 |
| 5,497,827 | A * | 3/1996 | Cornic | F22B 1/025 | 122/510 |
| 7,793,708 | B2 * | 9/2010 | Wanni | F28F 9/0132 | 122/510 |
| 2016/0001726 | A1 | 1/2016 | Keller et al. | | |

FOREIGN PATENT DOCUMENTS

| | | |
|---|---|---|
| JP | 5-71606 | 9/1993 |
| JP | 5-340502 | 12/1993 |
| JP | 05322103 A * | 12/1993 |
| JP | 7-71201 | 3/1995 |
| JP | 2000-225629 | 8/2000 |
| JP | 2002-13589 | 1/2002 |
| JP | 2002-273771 | 9/2002 |
| JP | 2012-251744 | 12/2012 |
| JP | 2013-193537 | 9/2013 |
| JP | 2016-507422 | 3/2016 |

OTHER PUBLICATIONS

International Preliminary Report on Patentability dated Sep. 26, 2017 in International (PCT) Application No. PCT/JP2016/000835.
Office Action dated Jul. 11, 2017 in Japanese Application No. 2015-052792, with English translation.

* cited by examiner

BOILER

TECHNICAL FIELD

The present invention relates to a suspended boiler, and particularly relates to a boiler provided with a mechanism capable of reducing the seismic response of equipment provided inside the boiler.

BACKGROUND ART

With boilers, the boiler main body is suspended by a steel support frame so that thermal expansion of the boiler main body during operation is not obstructed. Accordingly, when an earthquake occurs, the boiler main body exhibits pendulum motion inside the steel support frame like that of a hanging bell. As such, seismic damping devices are provided to restrict relative displacement between the boiler main body and the steel support frame.

For example, Patent Document 1 proposes a boiler seismic damping device including elastoplastic elements between a back stay provided outward of the boiler main body and a steel support frame suspension supporting the boiler main body; wherein the elastoplastic elements are divided into a plurality of groups.

CITATION LIST

Patent Document

Patent Document 1: Japanese Unexamined Patent Application Publication No. H05-340502A

SUMMARY OF INVENTION

Technical Problems

When earthquakes occur, not only does relative displacement between the boiler main body and the steel support frame occur, but, also, relative displacement between the boiler drum constituting the outer shell of the boiler main body and equipment provided inside the boiler drum occurs (hereinafter, the equipment provided inside the boiler drum is referred to as an "internal element") Note that, typically, this internal element is piping. However, while seismic damping devices in the related art, including the device recited in Patent Document 1, address the relative displacement between the boiler main body and the steel support frame, there are no examples that address reducing the seismic response of the internal elements.

Thus, an object of the present invention is to provide a suspended boiler capable of reducing the seismic response of an internal element provided inside a boiler drum.

Solution to Problem

A boiler according to an aspect of the present invention includes a boiler main body; and a steel support frame suspending and supporting the boiler main body. In such a boiler, the boiler main body includes a furnace wall composed of water pipes and plate-like fins arranged in an alternating manner; an internal element housed inside the furnace wall; and a buffering mechanism that interferes with the internal element and attenuates vibration energy when relative displacement, of the internal element with respect to the furnace wall, occurs that exceeds a predetermined value.

According to the aspect of the present invention, the buffering mechanism is provided that attenuates vibration energy when relative displacement of the internal element with respect to the furnace wall occurs that exceeds a predetermined value. As a result, the seismic response of the internal element can be reduced.

It is preferable that a load on the buffering mechanism of the present invention, caused by the interference resulting from the relative displacement in a main vibration direction of the internal element, is transmitted to the fins.

Additionally, in the boiler according to the present invention, the buffering mechanism may include an energy attenuating body that compresses to plastically deform due to the interference.

In cases where an energy attenuating body and a frame supporting the energy attenuating body and fixed to the furnace wall are provided as the buffering mechanism, it is preferable that the frame is fixed to the fins of the furnace wall. This frame may have energy attenuating capacity to compress to plastically deform due to the interference.

Additionally, it is preferable that a honeycomb structure is used as the energy attenuating body; and an axial line of this honeycomb structure may be disposed along the main vibration direction.

It is preferable that a pair of the buffering mechanism is provided, on both a forward side and a return side of the main vibration direction.

In the boiler according to the aspect of the present invention, the buffering mechanism includes a damping element fixed to the furnace wall, in which bending and shearing occurs; and an interference body fixed to the internal element, with which the damping element interferes.

It is preferable that a pair of the interference body is provided, on both a forward side and a return side of the main vibration direction.

Advantageous Effects of Invention

According to an aspect of the present invention, a buffering mechanism is provided that attenuates vibration energy when relative displacement of the internal element with respect to the furnace wall occurs that exceeds a predetermined value. As a result, a suspended boiler is provided whereby the seismic response of the internal element can be reduced.

BRIEF DESCRIPTION OF DRAWINGS

FIG. 2A is a partial cross-sectional plan view, and FIG. 2B is a side view.

DESCRIPTION OF EMBODIMENTS

The present invention will be described below in detail on the basis of embodiments illustrated in the attached drawings.

First Embodiment

Figure 1:
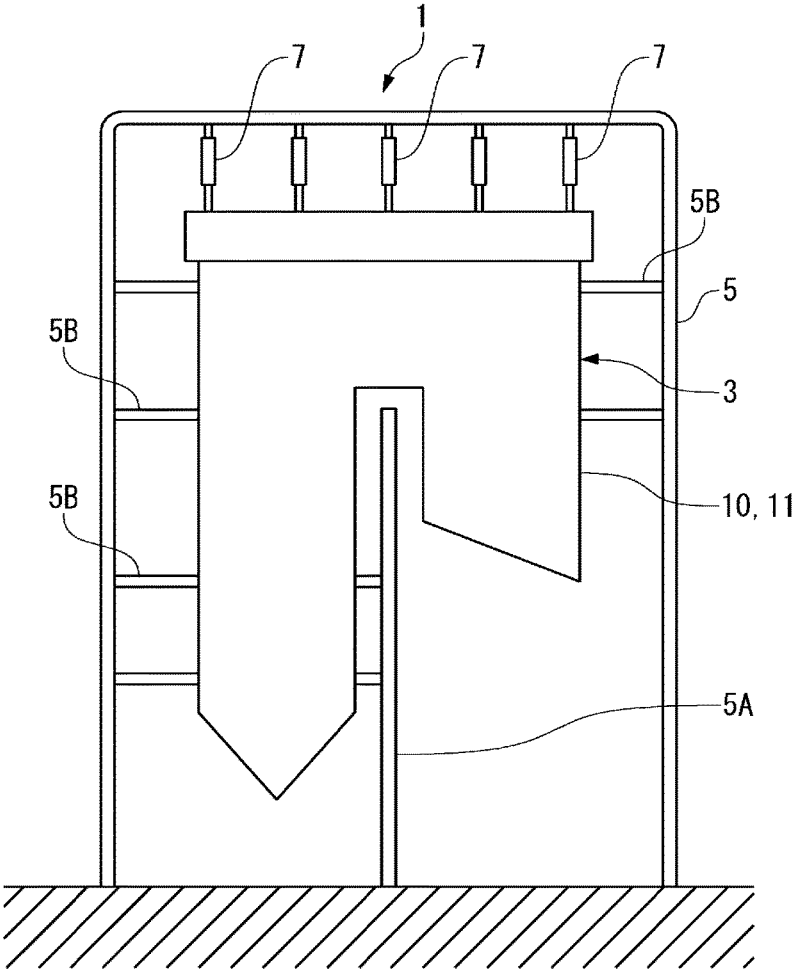
FIG. 1 is a drawing illustrating a schematic configuration of a suspended boiler according to an embodiment of the present invention.
Figure 2A:
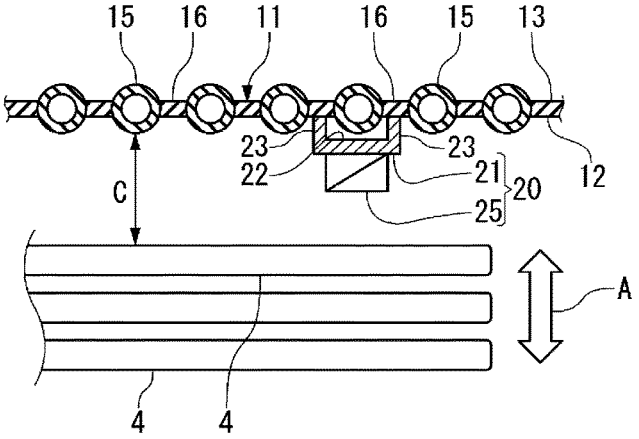
FIGS. 2A and 2B are drawings illustrating a buffering mechanism according to a first embodiment.
Figure 2B:
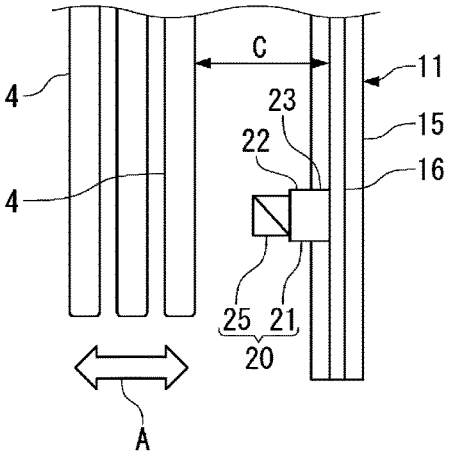

As illustrated in FIGS. 1, 2A, and 2B, a suspended boiler 1 according to the present embodiment includes a boiler main body 3 and a steel support frame 5 surrounding the boiler main body 3, wherein the boiler main body 3 is suspended from the steel support frame 5 by hanging members 7. Note that only a portion of the steel support frame 5 is illustrated in FIG. 1, but the steel support frame 5 is formed from a combination of a plurality of pillars 5A extending in a vertical direction, a plurality of beams 5B extending in a horizontal direction, and the like.

The boiler main body 3 includes a boiler drum 10 and an internal element 4 provided inside the boiler drum 10 and constituted primarily of piping. The present embodiment includes a buffering mechanism 20 that reduces the seismic response of the internal element 4 using the relationship between the internal element 4 and a furnace wall 11 of the boiler drum 10.

The furnace wall 11 is a membrane wall and, as illustrated in FIG. 2, is composed of water pipes 15 and plate-like fins 16 arranged in an alternating manner and joined by welding. Accordingly, an inner surface 12 and an outer surface 13 of the furnace wall 11 have uneven forms in which a portion of the outer peripheral surface shape of the water pipes 15 and the surface of the fins 16 repeat in an alternating manner. The furnace wall 11 is provided with the water pipes 15 primarily to prevent overheating, and recover and effectively use heat. These purposes are achieved by passing water and/or steam through the water pipes 15. Accordingly, from the perspective of maintaining the functions of the boiler 1, it can be said that, in the furnace wall 11, the water pipes 15 are more important constituents than the fins 16.

As illustrated in FIGS. 2A and 2B, the buffering mechanism 20 is fixed to the furnace wall 11 of the boiler drum 10. The furnace wall 11 includes an inner surface 12 facing the internal element 4 and an outer surface 13 opposite the inner surface 12, and, in the furnace wall 11, the buffering mechanism 20 is fixed to the inner surface 12 side.

In the structural design of the boiler 1, the buffering mechanism 20 is provided within a range of a clearance C set between the internal element 4 and the furnace wall 11 constituted by the water pipes 15 and the fins 16.

The buffering mechanism 20 includes a frame 21 that has a gate-shaped cross section, and an energy attenuating body 25 that is attached to the frame 21. When the internal element 4 interferes with the energy attenuating body 25, the energy attenuating body 25 attenuates the energy caused by this interference.

The frame 21 is made from, for example, grooved steel that has a gate-shaped cross-section, and includes a web 22 and a pair of flanges 23, 23 connected to both ends of the web 22. The flanges 23, 23 straddle the water pipes 15 of the furnace wall 11 and are fixed to the fins 16 by welding, for example. Thus, the buffering mechanism 20 is fixed so that the load is not transmitted directly to the water pipes 15.

The energy attenuating body 25 is fixed to the web 22 of the frame 21 by welding, for example.

The energy attenuating body 25 plastically deforms upon interference by the internal element 4 when earthquake ground motion occurs and the internal element 4 shakes greater than expected. As a result, the energy attenuating body 25 attenuates the kinetic energy and reduces the seismic response. In order to achieve this, the energy attenuating body 25 is provided with mechanical characteristics whereby the energy attenuating body 25 yields prior to the internal element 4 and/or the furnace wall 11 becoming damaged when the internal element 4 interferes with the energy attenuating body 25.

Note that, due to the structure of the boiler main body 3, shaking in the direction of the solid white arrow A in FIGS. 2A and 2B is expected to be greater than shaking in the direction orthogonal thereto when earthquake ground motion occurs. As such, the direction of the solid white arrow A is defined as the main vibration direction A.

Additionally, the frame 21 and the energy attenuating body 25 of the buffering mechanism 20 are formed from the same heat-resistant steel as the internal element 4 and the furnace wall 11.

Figure 3A:
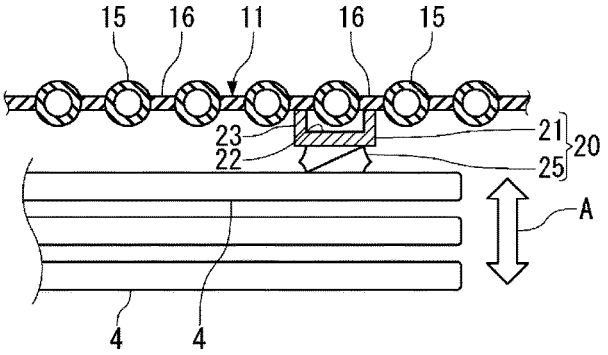
FIGS. 3A, 3B and 3C are drawings explaining operations and effects of the buffering mechanism according to the first embodiment when the first embodiment is subjected to earthquake ground motion.
Figure 3B:
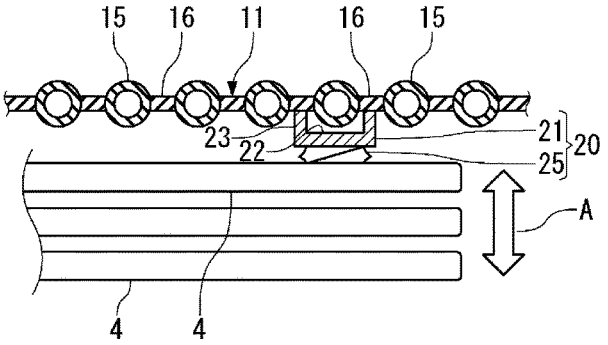

Next, operations and effects of the buffering mechanism 20 when the boiler 1 provided with the buffering mechanism 20 is subjected to earthquake ground motion are described while referencing FIGS. 3A and 3B.

When earthquake ground motion is received and the internal element 4 becomes relatively displaced from the normal state illustrated in FIG. 3A so as to approach and ultimately interfere with and impact the energy attenuating body 25, the energy attenuating body 25 compresses to plastically deform as illustrated in FIG. 3B, and attenuates the energy resulting from the earthquake ground motion. The internal element 4 separates from the energy attenuating body 25 once due to the swing-back of the earthquake ground motion, but then interferes again with the energy attenuating body 25. The amount of displacement of the internal element 4 at this time is greater than the previous relative displacement. Accordingly, the energy attenuating body 25 compresses more than at the previous interference in order to attenuate the earthquake ground motion energy.

Figure 3C:
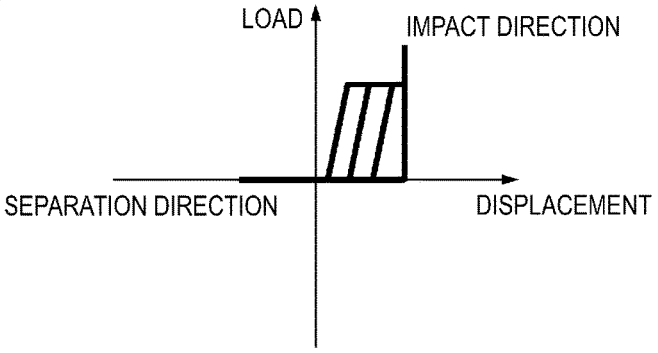

The energy attenuating body 25 repeats this behavior and, as a result, reduces the seismic response of the internal element 4 while exhibiting the load-displacement relationship illustrated in FIG. 3C.

In the buffering mechanism 20, while the energy attenuating body 25 attenuates the energy, the load is borne by the frame 21. As such, the load is transmitted to the furnace wall 11 to which the frame 21 is fixed. It is desirable that the functions of the furnace wall 11 are not lost due to the load. In order to meet this demand, in the present embodiment, the frame 21 is fixed to the fins 16 and, as a result, the load is borne by the fins 16 and is not directly transmitted to the water pipes 15. As described above, the water pipes 15 can be said to be responsible for the functions of the boiler 1 and, as such, the frame 21 straddles the water pipes 15, and the flanges 23, 23 are attached to the fins 16. As a result, even if the fins 16 become damaged, the functions of the boiler 1 will be ensured.

As described above, according to the present embodiment, the buffering mechanism 20 that attenuates energy within the clearance C is provided. As such, the seismic response of the internal element 4 can be reduced and seismic response reduction effects of the overall steel support frame 5 of the boiler 1 can be obtained due to the energy attenuating effects.

Furthermore, according to the present embodiment, a structure is used in which the load from the buffering mechanism 20 is borne by the fins 16 and is not directly transmitted to the water pipes 15. As such, the functions of the boiler 1 can be ensured.

In the preceding, a description of a single buffering mechanism 20 was given. However, depending on the load expected to result from the earthquake ground motion, a plurality of buffering mechanisms 20 may be installed in the plan direction and the height direction. That is, an appropriate number of buffering mechanisms 20 may be installed at locations considered to be most effective from the perspective of the vibration mode of the internal element 4. In general, it is preferable that the buffering mechanism 20 be installed at locations where the vibration mode of the internal element 4 is the largest.

In the preceding, a configuration is described in which the web 22 and the flanges 23, 23 do not contact the water pipes 15 in order to avoid damaging the water pipes 15. However, provided that the functions of the water pipes 15 can be maintained, the web 22 and the flanges 23, 23 may contact the water pipes 15. However, in this case as well, it is assumed that the load will be primarily borne by the fins 16.

Additionally, in the preceding, a configuration was described in which the energy attenuating body 25 of the buffering mechanism 20 plastically deforms, but the frame 21 may also plastically deform simultaneously or in a delayed manner in order to attenuate the energy.

Figure 4A:
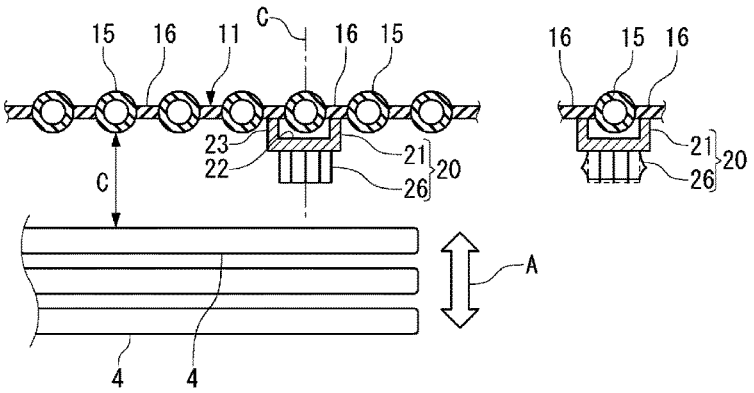
FIGS. 4A and 4B are drawings illustrating an example of a preferable energy attenuating body according to the first embodiment.
Figure 4B:
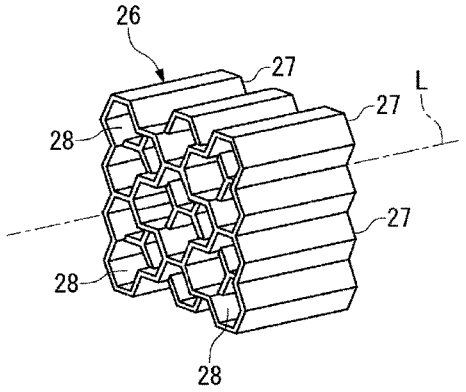

Next, though optional so long as the effects described above can be obtained, a preferable example of the energy attenuating body used in the present embodiment is described in detail while referencing FIGS. 4A and 4B. Note that, in FIGS. 4A and 4B, constituents that are the same as those in FIGS. 2A and 2B are marked with the same reference signs as in FIGS. 2A and 2B.

A honeycomb core 26 illustrated in FIG. 4B is proposed as a preferable example of the energy attenuating body.

As illustrated in FIG. 4B, the honeycomb core 26 has a structure formed by assembling a plurality of hexagonal cells 27, for example. A hexagonal through-hole 28 penetrating along an axial line L of the cell 27 is formed in each cell 27, and this through-hole 28 is open to both ends of the cell 27.

As illustrated in FIGS. 4A and 4B, the energy attenuating body made from the honeycomb core 26 is fixed to the frame 21 such that a compression direction of the honeycomb core 26 when the internal element 4 interferes with the honeycomb core 26 matches the axial line L direction.

The honeycomb core 26 compress and deforms when the internal element 4 interferes and, as a result, attenuates the energy resulting from the impact force of the internal element 4. An example of these changes will be described while referencing FIGS. 5A to 5D.

Figures 5A, 5B, 5C:
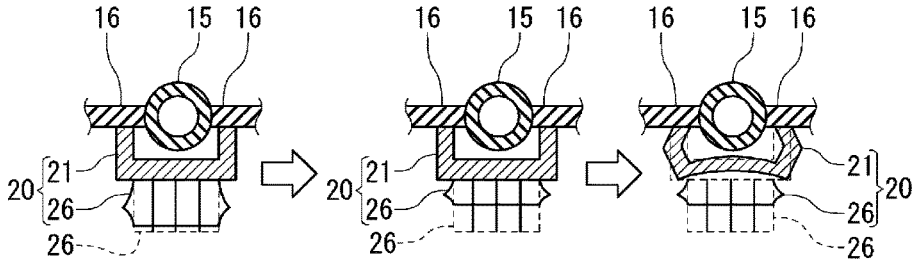
FIG. 5A to 5D are drawings illustrating a process through which the energy attenuating body illustrated in FIGS. 4A and 4B plastically deforms.
Figure 5D:
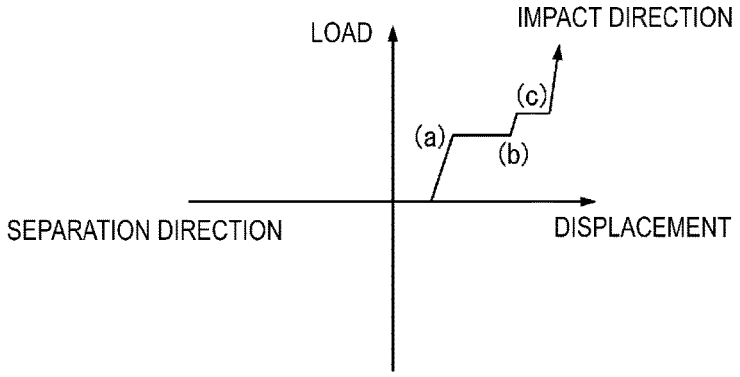

Due to interference of the internal element 4, the honeycomb core 26 deforms and compresses from an initial state indicated by the dashed lines in FIG. 5A, and ultimately reaches a completely collapsed state illustrated in FIG. 5B. At this point, the honeycomb core 26 has lost energy attenuating capacity. Thereafter, if a large relative displacement of the internal element 4 occurs, as illustrated in FIG. 5C, the frame 21 plastically deforms instead of the honeycomb core 26, and the entire buffering mechanism 20 takes responsibility for attenuating the energy. FIG. 5D is a load-displacement line diagram illustrating the changes depicted in FIGS. 5A to 5C. Note that (a), (b), and (c) in FIG. 5D correspond to the states depicted in FIGS. 5A, 5B, and 5C, respectively.

Figure 6A:
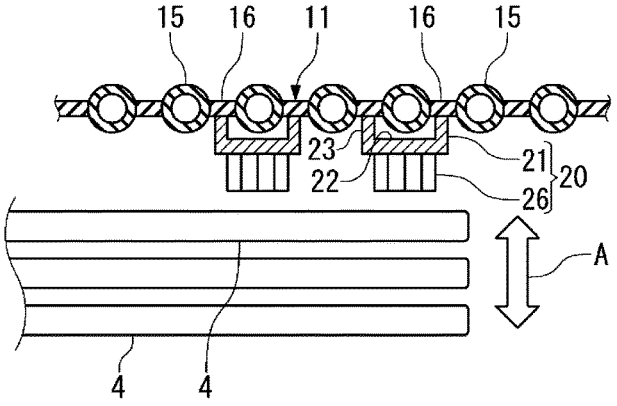
FIGS. 6A and 6B are drawings illustrating a modified example of the energy attenuating body illustrated in FIGS. 4A and 4B.
Figure 6B:
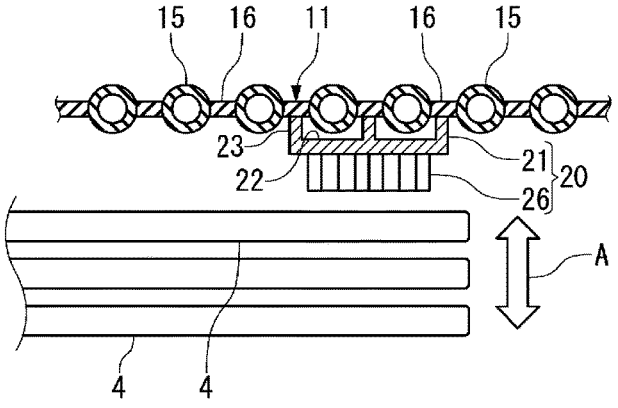

As with the energy attenuating body 25, the honeycomb core 26 as the energy attenuating body is also provided with mechanical characteristics whereby the honeycomb core 26 yields prior to the internal element 4 and the furnace wall 11 becoming damaged, and an appropriate number of buffering mechanisms 20 provided with the honeycomb core 26 may be installed at locations considered to be most effective from the perspective of the vibration mode of the internal element 4. Specifically, as illustrated in FIG. 6A, a plurality of buffering mechanisms 20 can be provided at intervals or, as illustrated in FIG. 6B, a buffering mechanism 20 having a dimension spanning three of the fins 16 can be provided.

Second Embodiment

Next, a second embodiment of the present invention will be described while referencing FIGS. 7A to 7D. Note that the same reference signs as used in FIGS. 2A and 2B are used in FIGS. 7A to 7D for configurations that are the same as in the first embodiment.

A buffering mechanism 30 according to the second embodiment utilizes a damping structure that is subjected to bending and shearing, and is configured to be capable of attenuating energy resulting from reciprocating vibration caused by earthquake ground motion.

Figure 7A:
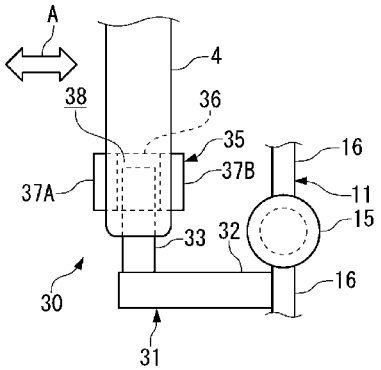
FIGS. 7A to 7D are partial cross-sectional plan views illustrating a buffering mechanism according to a second embodiment.
Figure 7B:
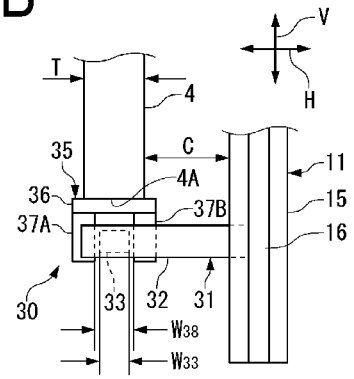

As illustrated in FIGS. 7A and 7B, the buffering mechanism 30 is provided on a first end portion in the horizontal (width) direction H of the internal element 4 closest to the furnace wall 11, on a lower end portion in the vertical (up-down) direction V. The buffering mechanism 30 includes a main damping element 31 provided on the furnace wall 11 side, and a damper bearing 35 provided on the internal element 4 side and that interferes with the main damping element 31 when vibration occurs in the main vibration direction A that exceeds a predetermined value.

The main damping element 31 includes a first arm 32 extending perpendicularly from the furnace wall 11, and a second arm 33 extending parallel to the furnace wall 11. A first end (fixed end) side of the first arm 32 is fixed to a fin 16 of the furnace wall 11, and a second end (free end) side of the first arm 32 is fixed to a first end (fixed end) side of the second arm 33.

The first arm 32 of the main damping element 31 is located at a position separated exactly a first predetermined distance from an end portion in the horizontal direction H of the internal element 4; and the second arm 33 of the main damping element 31 is located at a position separated exactly a second predetermined distance from the lower end portion in the vertical direction V of the internal element 4.

The damper bearing 35 is a member made from, for example, grooved steel that has a gate-shaped cross-section, and is attached to a bottom surface 4A of the internal element 4. The damper bearing 35 includes a fixing portion 36 fixed to the bottom surface 4A, and a pair of stoppers 37A and 37B hanging from both ends in the width direction of the fixing portion 36. Note that here, the "width direction" matches the direction in which the earthquake ground motion occurs. Here, the fixing portion 36 and the stoppers 37A and 37B are made from rectangular plates, but this is just an example and, provided that the desired goals can be achieved, the form is not limited thereto.

The damper bearing 35 includes an insertion gap 38 between the stoppers 37A and 37B, and the second arm 33 of the main damping element 31 is inserted into this insertion gap 38. A width W38 of the insertion gap 38 is configured to be greater than a thickness T of the internal element 4 and, at stationary times, the internal element 4 is separated from the stoppers 37A and 37B.

Next, operations and effects of the buffering mechanism 30 when the boiler 1 provided with the buffering mechanism 30 is subjected to earthquake ground motion are described.

When the subjected to earthquake ground motion and the internal element 4 relatively displaces from a normal state, the stopper 37A of the damper bearing 35 approaches and ultimately interferes with the second arm 33. Upon interference, the second arm 33 of the main damping element 31 is subjected to bending and shearing, plastically deforms, and attenuates the energy of the earthquake ground motion. The second arm 33 separates once from the stopper 37A due to the swing-back of the earthquake ground motion and, this time, interferes with the stopper 37B. The amount of displacement of the internal element 4 at this time is greater than the previous relative displacement. Accordingly, the second arm 33 is subjected to bending and shearing, plastically deforms, and compresses more than at the previous interference in order to attenuate the earthquake ground motion energy.

Figure 7C:
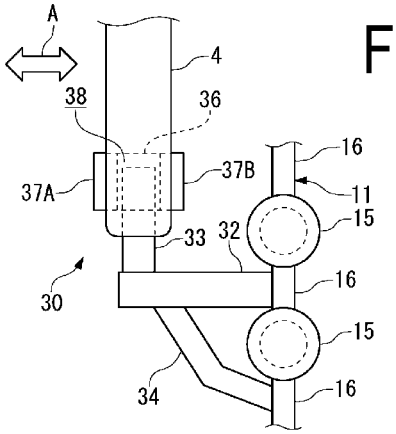
Figure 7D:
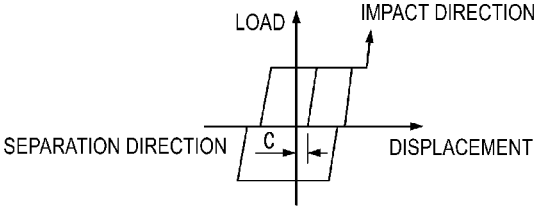

The second arm 33 of the main damping element 31 repeats this behavior and, as a result, reduces the seismic response of the internal element 4 while exhibiting the load-displacement relationship illustrated in FIG. 7D. Note that, as illustrated in FIG. 7C, the structure of the first arm 32 can be made smaller by providing a reinforcing arm 34 that reinforces the first arm 32 between the first arm 32 and the fin 16.

In this configuration, the second arm 33 is primarily responsible for plastically deforming and attenuating the energy. However, as described in the first embodiment, a configuration is possible in which the support member, namely the first arm 32 of FIGS. 7A and 7B, the first arm 32 of FIG. 7C, the reinforcing arm 34, and the stoppers 37A and 37B are plasticized.

With the buffering mechanism 30 according to the second embodiment, as with the buffering mechanism 20 of the first embodiment, the seismic response of the internal element 4 can be reduced and seismic response reduction effects of the overall steel support frame 5 of the boiler 1 can be obtained due to the energy attenuating effects. Additionally, a structure is used in which the load from the buffering mechanism 30 is borne by the fins 16 and is not directly transmitted to the water pipes 15. As such, the functions of the boiler 1 can be ensured.

In addition, in the second embodiment, the pair of stoppers 37A and 37B are provided at an interval in the main vibration direction A, thereby making it possible to attenuate energy on both the forward side and the return side of the reciprocating vibration. Moreover, in cases where reciprocating vibration occurs repeatedly, such as with earthquake ground motion, a greater amount of energy is attenuated and greater seismic response reduction effects are obtained.

Additionally, the buffering mechanism 20 of the first embodiment is required to be installed between the internal element 4 and the furnace wall 11 and, as such, the installation position may be limited by the space between the internal element 4 and the furnace wall 11. In contrast, the buffering mechanism 30 of the second embodiment can be provided on the bottom surface 4A of the internal element 4 and, as such, is mostly free of limitations on the installation position. Additionally, with the buffering mechanism 20, the compression amount (deformation amount) of the energy attenuating body 25 is required to be smaller than the space between the internal element 4 and the furnace wall 11. However, with the buffering mechanism 20 in which the damper bearing 35 is provided on the bottom surface 4A of the internal element 4, this limitation does not exist and, as a result, the deformation amount can be increased.

Two preferable embodiments of the present invention have been described. However, as long as there is no departure from the spirit and scope of the present invention, configurations described in the above embodiments can be selected as desired, or can be changed to other configurations as necessary.

REFERENCE SIGNS LIST

1 Boiler
3 Boiler main body
4 Internal element
4A Bottom surface
5 Steel support frame
7 Hanging member
10 Boiler drum
11 Furnace wall
12 Inner surface
13 Outer surface
15 Water pipe
16 Fin
20 Buffering mechanism
21 Frame
22 Web
23 Flange
25 Energy attenuating body
26 Honeycomb core
27 Cell
28 Through-hole
30 Buffering mechanism
31 Main damping element
32 First arm
33 Second arm
34 Reinforcing arm
36 Fixing portion
37A, 37B Stopper
38 Insertion gap
C Clearance

The invention claimed is:

1. A boiler, comprising:

a boiler main body; and a steel support frame suspending and supporting the boiler main body, wherein the boiler main body includes:

a furnace wall composed of water pipes and plate-like fins arranged in an alternating manner;

an internal element housed inside the furnace wall; and a buffering mechanism configured to interfere with the internal element to attenuate vibration energy when relative displacement, of the internal element with respect to the furnace wall, occurs and exceeds a predetermined value, wherein the furnace wall includes an inner surface facing the internal element and an outer surface opposite the inner surface, the buffering mechanism is fixed to the inner surface of the furnace wall, the buffering mechanism includes an energy attenuating body configured to compress to plastically deform due to the interference, and the energy attenuating body is configured to have mechanical characteristics whereby the energy attenuating body yields prior to the internal element and the furnace wall becoming damaged when the internal element interferes with the energy attenuating body.

2. The boiler according to claim 1, wherein a load on the buffering mechanism, caused by the interference resulting from the relative displacement in a main vibration direction of the internal element, is transmitted to the fins.

3. The boiler according to claim 1, wherein the buffering mechanism includes a frame supporting the energy attenuating body and fixed to the furnace wall, and wherein the frame is fixed to the fins of the furnace wall.

4. The boiler according to claim 2, wherein the buffering mechanism includes a frame supporting the energy attenuating body and fixed to the furnace wall, and wherein the frame is fixed to the fins of the furnace wall.

5. The boiler according to claim 3, wherein the frame has energy attenuating capacity to compress to plastically deform due to the interference.

6. The boiler according to claim 4, wherein the frame has energy attenuating capacity to compress to plastically deform due to the interference.

7. The boiler according to claim 1, wherein the energy attenuating body comprises a honeycomb structure, and an axial line of the honeycomb structure is disposed along the main vibration direction.

8. The boiler according to claim 3, wherein the energy attenuating body and the frame of the buffering mechanism are made from heat-resistant steel.

9. The boiler according to claim 3, wherein:

the frame includes a web, and a pair of flanges connected to both ends of the web;

the energy attenuating body is fixed to the web of the frame; and the pair of flanges straddles the water pipes of the furnace wall and is fixed to the fins.

10. The boiler according to claim 9, wherein:

the energy attenuating body is fixed to the web of the frame by welding; and the pair of flanges is fixed to the fins by welding.

11. The boiler according to claim 10, wherein the buffering mechanism is fixed to the fins such that the load caused by the interference is not directly transmitted to the water pipes.

12. The boiler according to claim 1, wherein the internal element is piping.

13. The boiler according to claim 2, wherein a pair of the buffering mechanisms is provided, on both a forward side and a return side of the main vibration direction.

14. The boiler according to claim 1, wherein the buffering mechanism includes:

a damping element fixed to the furnace wall, in which bending and shearing occurs; and an interference body fixed to the internal element, with which the damping element interferes.

15. The boiler according to claim 14, wherein a pair of the interference bodies is provided, on both a forward side and a return side of the main vibration direction.

* * * * *